US007503667B2

(12) United States Patent
Wilkings

(10) Patent No.: US 7,503,667 B2
(45) Date of Patent: Mar. 17, 2009

(54) LIGHTED GLOVE

(76) Inventor: Troy Wilkings, P.O. Box 670975, Chugiak, AK (US) 99567

( * ) Notice: Subject to any disclaimer, the term of this patent is extended or adjusted under 35 U.S.C. 154(b) by 0 days.

(21) Appl. No.: 11/023,852

(22) Filed: Dec. 24, 2004

(65) Prior Publication Data

US 2006/0139911 A1 Jun. 29, 2006

(51) Int. Cl.
*F21V 21/08* (2006.01)

(52) U.S. Cl. ..... 362/103; 362/800; 362/184

(58) Field of Classification Search ..... 362/103, 362/184, 159, 160, 234, 800, 105
See application file for complete search history.

(56) References Cited

U.S. PATENT DOCUMENTS

| | | | | | |
|---|---|---|---|---|---|
| 3,638,011 | A | | 1/1972 | Bain et al. | |
| 4,234,907 | A | | 11/1980 | Daniel | |
| 5,448,458 | A | | 9/1995 | Smyly, Jr. | |
| 5,535,105 | A | | 7/1996 | Koenen et al. | |
| 5,580,154 | A | * | 12/1996 | Coulter et al. | 362/103 |
| 5,816,676 | A | | 10/1998 | Koenen Myers et al. | |
| 6,006,357 | A | * | 12/1999 | Mead | 2/160 |
| 6,592,235 | B1 | * | 7/2003 | Mayo | 362/103 |
| 6,709,142 | B2 | * | 3/2004 | Gyori | 362/554 |
| 6,711,746 | B1 | * | 3/2004 | Orellana | 2/160 |
| 6,892,397 | B2 | * | 5/2005 | Raz et al. | 2/160 |
| 7,399,099 | B2 | * | 7/2008 | Stokes | 362/103 |
| 7,401,937 | B2 | * | 7/2008 | Abas | 362/103 |
| 2003/0235048 | A1 | * | 12/2003 | Gyori | 362/103 |
| 2004/0128736 | A1 | | 7/2004 | Raz et al. | |
| 2006/0007669 | A1 | * | 1/2006 | Blackburn | 362/103 |

OTHER PUBLICATIONS 555 918, Jun. 17, 2004, Troy Wilkings, Whole Filing.

* cited by examiner

*Primary Examiner*—Ali Alavi
*Assistant Examiner*—Evan Dzierzynski
(74) *Attorney, Agent, or Firm*—Wells St. John, P.S.

(57) ABSTRACT

A lighted glove, including a front surface and a back surface; an inner area defined between the front and back surfaces, the inner sized to receive a hand of a user; a wrist band sized for transitioning a hand into and out of the inner area; fingers formed between the front surface and back surface, each finger having a base knuckle area, a thumb formed between the front surface and back surface, the thumb having a base knuckle area, the thumb positioned at one end of a row of fingers; crotches between each of the base knuckle areas of the thumb and fingers; at least one light emitting diode positioned on the front surface in the crotch; and wiring joining the light emitting diode to a power source.

20 Claims, 6 Drawing Sheets

LIGHTED GLOVE

FIELD OF THE INVENTION

The present invention relates to gloves and more particularly to lights mounted on gloves.

BACKGROUND OF THE INVENTION

Lighted gloves have long been desirable as people want the source of light where they can use it. People often work with their hands such that light at the source of the hands is highly desirable. The light, however, should be even more specifically located at the palm side of the hand as that is the side where manipulations may be performed. Many attempts have been made, but all are found lacking.

U.S. Pat. No. 6,711,746, entitled Glove Apparatus, issued to Orellana on Mar. 30, 2004 discloses a glove that has light around the palm area of the hand. The light source, however, is chemically based light, col. 2, lines 51-57, which provides a weak light that is of a single use variety. These chemical lights are positioned on the parts of the glove that typically receive the most wear or usage, since the pressure of use causes the chemicals to mix. Such a location interferes with a users functioning of their hand as they lose tactile communication with the object being manipulated.

U.S. Pat. No. 6,709,142, entitled Nighttime Glove, issued to Gyori discloses an alternate location the tips of the gloves. While the light is close to the palms, objects being manipulated remain in the shadows adjacent the light source and the lights interfere with the tactile contact as user may desire in the finger tips. U.S. Pat. No. 6,592,235 (Mayo), entitled Light Emitting Glove and U.S. Pat. No. 5,535,105 (Koenen Meyeres et al.), entitled Work Glove and Illumination Assembly have similar locations and problems.

United States Patent Application 2004/0128736 discloses a Glove with Integrated Light. Here the light is positioned on the back of the glove and lacks lighting in the palm area as shown in FIG. 2 thereof. Similar positioning and problems are found in U.S. Pat. No. 5,816,676 (Koenen Myers et al.) and U.S. Pat. No. 3,638,011 (Bain et al.)

Mead discloses in U.S. Pat. No. 6,006,357 a signaling glove. The glove includes a light in the palm area where such light interferes with tactile contact with the object and is easily damages both the light and user's hand when pressure is applied with the hand.

To get around pressure problem, tactile interference, damage to the system and yet keep the light near the palm, Smyly Jr. came up with an interesting approach. A pen-shaped is attached to the back of the hand with a tip pointing toward the palm. Such bulky configuration is perhaps the safest and most functional of all the prior attempts.

What is needed is a lighted glove where the lights are more than a single use type, e.g., non-chemical. The light should be positioned on the palm side of the glove, yet should be positioned in such a location that the light does not suffer through unnecessary stresses. The light should not interfere with normal tactile feel. Moreover, the light and associated connections should be protected from the corrosive effects of human sweat. The prior attempts have sought to meet these needs, but are found lacking in the execution.

SUMMARY OF THE INVENTION

The present invention is a lighted glove, provided with a front surface and a back surface. An inner area is defined between the front and back surfaces, being sized to receive a hand of a user. A wrist band is sized and positioned for transitioning a hand into and out of the inner area. Fingers are formed between the front surface and back surface, with each finger having a base knuckle area. A thumb is formed between the front surface and back surface, having a base knuckle area. The thumb positioned at one end of a row of fingers. Crotches are positioned between each of the base knuckle areas of the thumb and fingers. At least one light emitting diode is positioned on the front surface in the crotch. Wiring joins the light emitting diode to a switch and to a power source.

Advantageously, the present invention allows for greater light emission of electronic lights positioned in the palm area.

As yet a further advantage, the light bulbs/diodes are positioned in a location of the palm where pressure does not risk damage to the bulb or wiring connections.

As still yet another advantage, a coating may be applied over the bulb/diode and wire combination to protect the connection from the corrosive effects of sweat and water.

These and other advantages will become clear through reading the following description with reference to the appended drawings.

DETAILED DESCRIPTION

Figure 1:
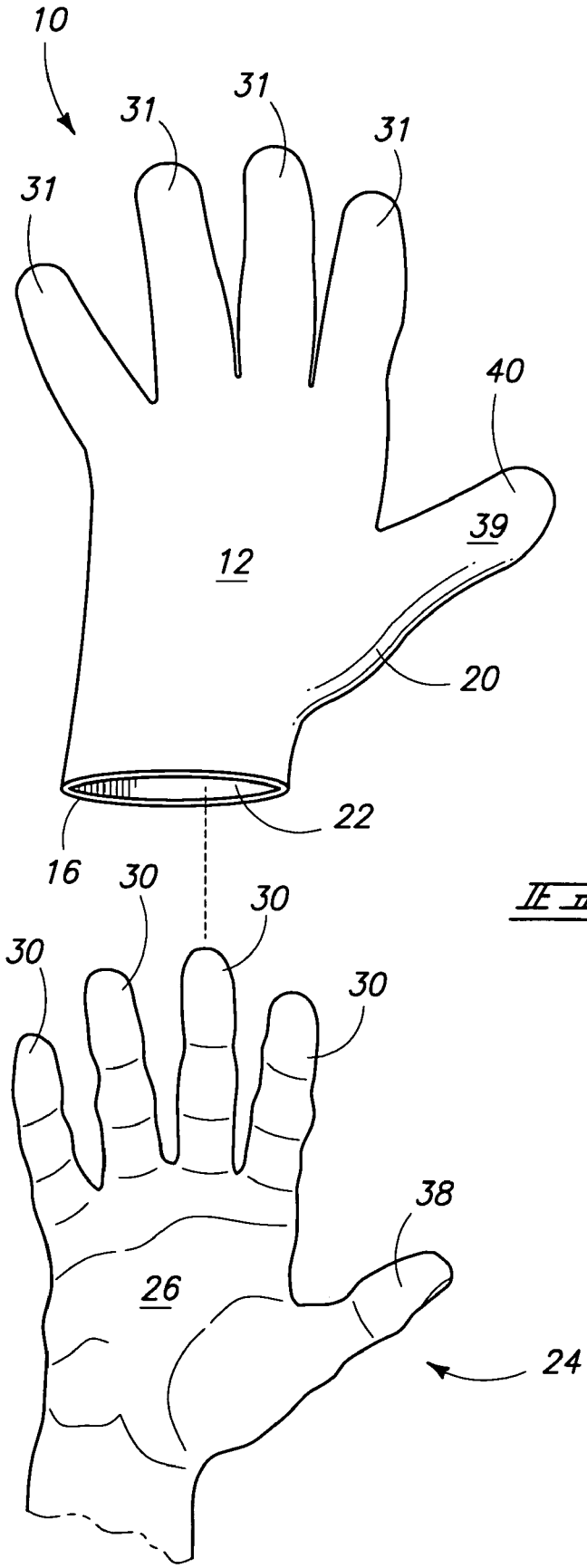
FIG. 1 is a view of the front surface of the right lighted glove, showing insertion of a hand therein.

The present invention is a lighted glove 10 which may be provided with light emitting diodes 50 positioned on the front surface 12, i.e., palm area of the glove 10. The type of light and positioning are considered critical to this invention in that the light source is much brighter than other palm connected light sources and the positioning best minimizes damage to the light source and interference with the user. The interconnected components will be discussed below, but first a couple of terms should be defined so as to better understand the positioning of the LEDs.

Definitions

Finger base knuckle area 34—a portion of the glove 10 that directly overlies the typical location of a callous at the base of a finger. An observer may note that human fingers tend to move well in a plane perpendicular to the plane defined by the palm 26 of the hand 24. The largest knuckle of each finger, e.g., where the finger joins to the palm 26, commonly have two callouses associated therewith. Both callouses are in the plane in which a finger typically moves, e.g. perpendicular to the palm 26, one on the front of the hand 24 and one on the back of the hand 24. Finger base knuckles areas 34 of a glove 10 are subject to substantial pressure, wear and tear as evidenced by callouses on the human hand.

Finger crotch area 36—an area of a glove 10 that directly overlies a portion of the human hand 24 that typically receives little to no pressure variation. Specifically the area is defined by the area in between two adjacent finger base knuckle areas 34 on the palm area 46 and extends back between the fingers 30 and finger base knuckle areas 34 on the palm area 46. The portion of the human hand 24 directly underlying the finger crotch 36 of the glove 10 is characterized by non-calloused fleshy tissue.

Finger crotch center 48—part of the finger crotch 36 directly between adjacent fingers 30.

Thumb base knuckle area 42—a portion of the glove 10 that directly overlies the typical location of a callous at the base of a thumb. An observer may note that the thumb tends to have greater range of motion in more planes without loss of strength than what is found in fingers, but that such movement tends to be restricted to one side of the plane defined by the palm 26 of the hand 24. For this reason, the calloused area tends to be much broader than that of a finger in the palm area, while remaining small on the back of the hand 24. Thumb base knuckles areas 42 are subject to substantial pressure, wear and tear as evidenced by callouses on the human hand.

Thumb crotch area 44—an area of a glove 10 that directly overlies a portion of the human hand 24 that typically receives little to no pressure variation. Specifically the area is adjacent a finger base knuckle area 34 on the palm area 46 and the thumb base knuckle area 42 and extends back between the finger 30 and thumb 38. This corresponding area on the human hand is characterized as lacking the adjacent development of callouses and is quite fleshy with bones at the outer edge thereof.

Thumb crotch center 49—part of the thumb crotch 44 directly between the adjacent finger 30 and thumb 38.

Discussion

The glove 10 may have an outer layer 20 with a front surface 12 and a back surface 14. The lining 18 underlies the outer layer 20, defining an inner area 22 sized to receive a hand 24 of a user. A wrist band 16, with or without elastic is sized and positioned for transitioning a hand 24 into and out of the inner area 22.

Figure 2:
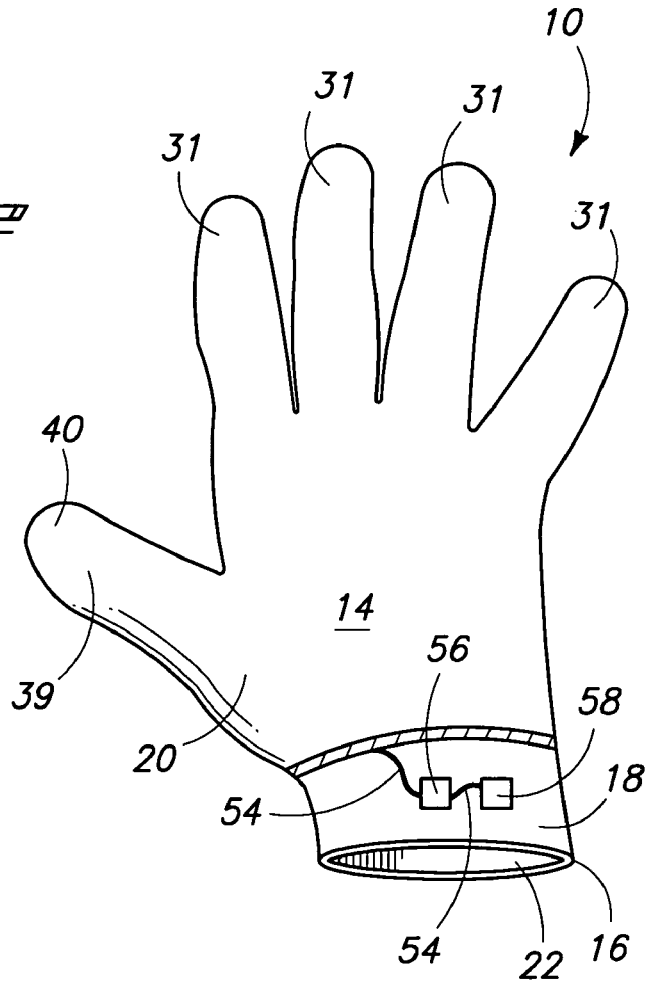
FIG. 2 is a back view of the right lighted glove partially broken away to show the switch, wiring and power source between the inner and outer layers.
Figure 3:
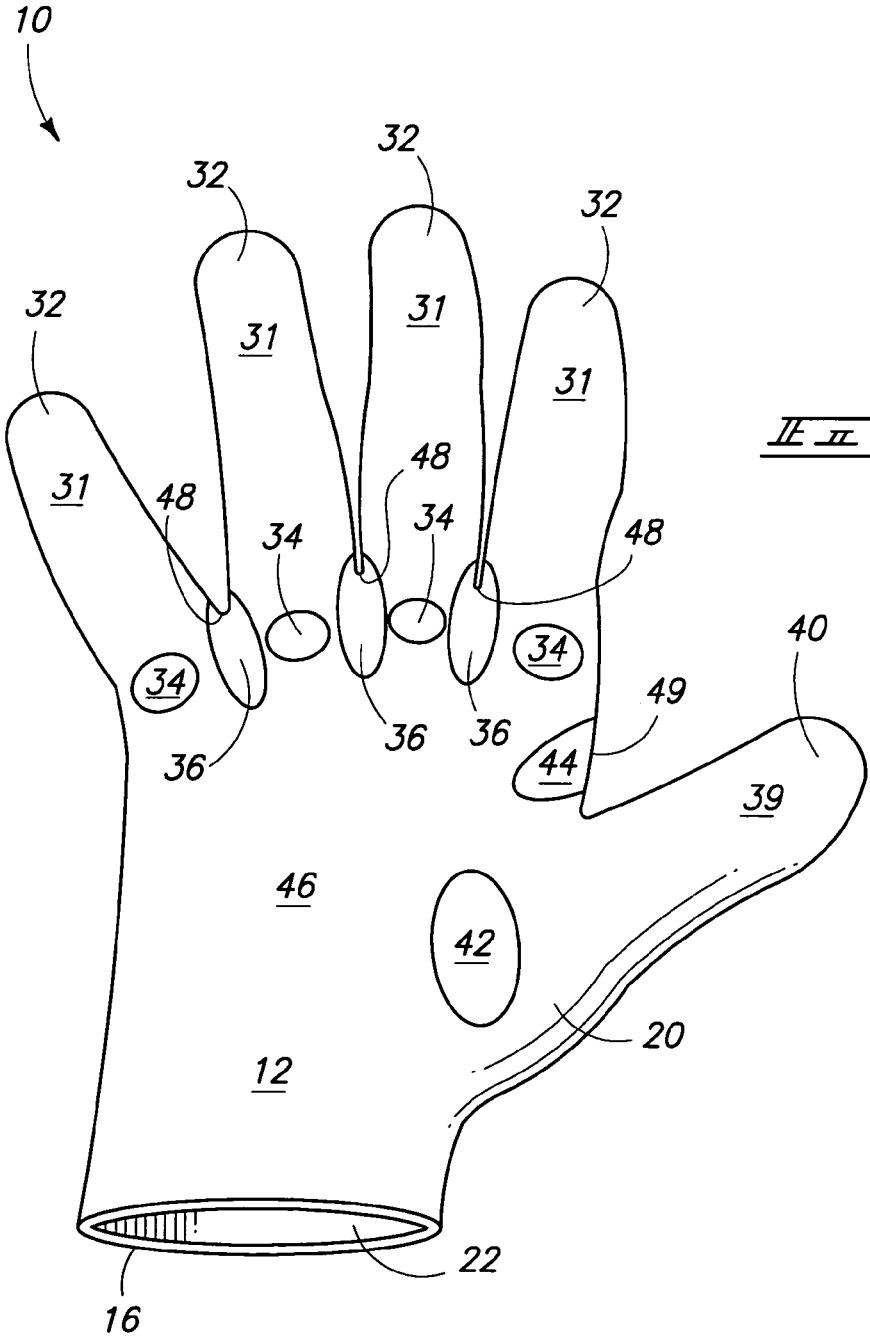
FIG. 3 is an enlarged view of FIG. 1, demonstrating the base knuckle areas and the crotches on the front surface.
Figure 4:
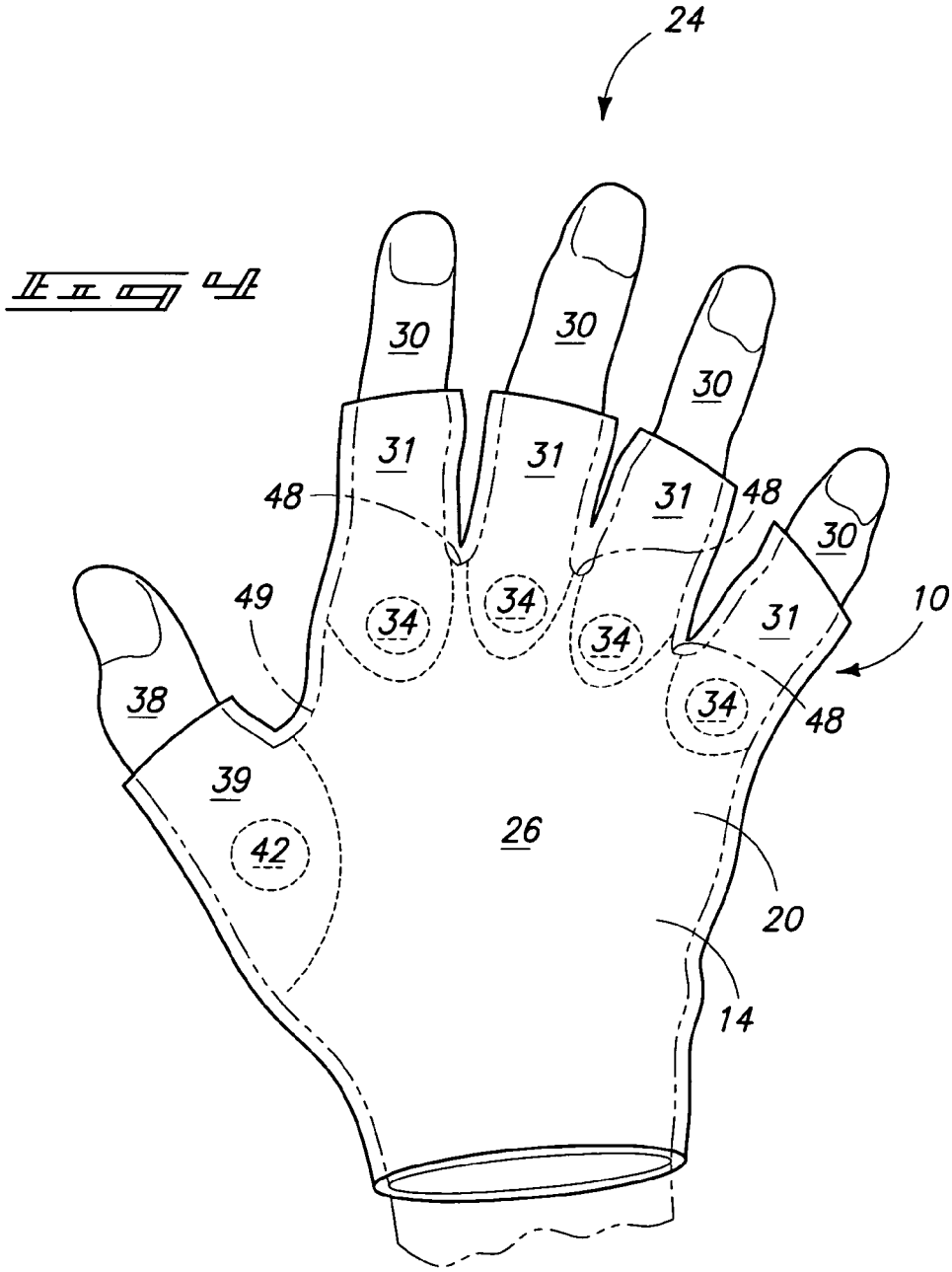
FIG. 4 is an enlarged view of FIG. 2, demonstrating the base knuckle areas and the crotches on the back surface.

Fingers 30 may be formed by the outer layer 20 and lining 18. Each finger has a pair of base knuckle areas 34 as shown in the drawings and heretofore described. Each finger 31 may have a tip 32 as shown in FIGS. 1, 2 and elsewhere or the tips may be removed as shown in FIG. 4. Finger crotches 36 with a center 48, both previous defined are positioned between the finger base knuckle areas 34.

A thumb may be formed by the outer layer 20 and lining 18. The thumb 38 may have a tip 40 as shown in FIGS. 1 and 2 or may have the tip 40 removed as shown in FIG. 4. The thumb 39 has a base knuckle area 42. The thumb 38 is positioned at one end of a row of fingers 30. The thumb crotch 44 is positioned between the thumb base knuckle area 42 and the adjacent finger base knuckle area 34.

Figure 5:
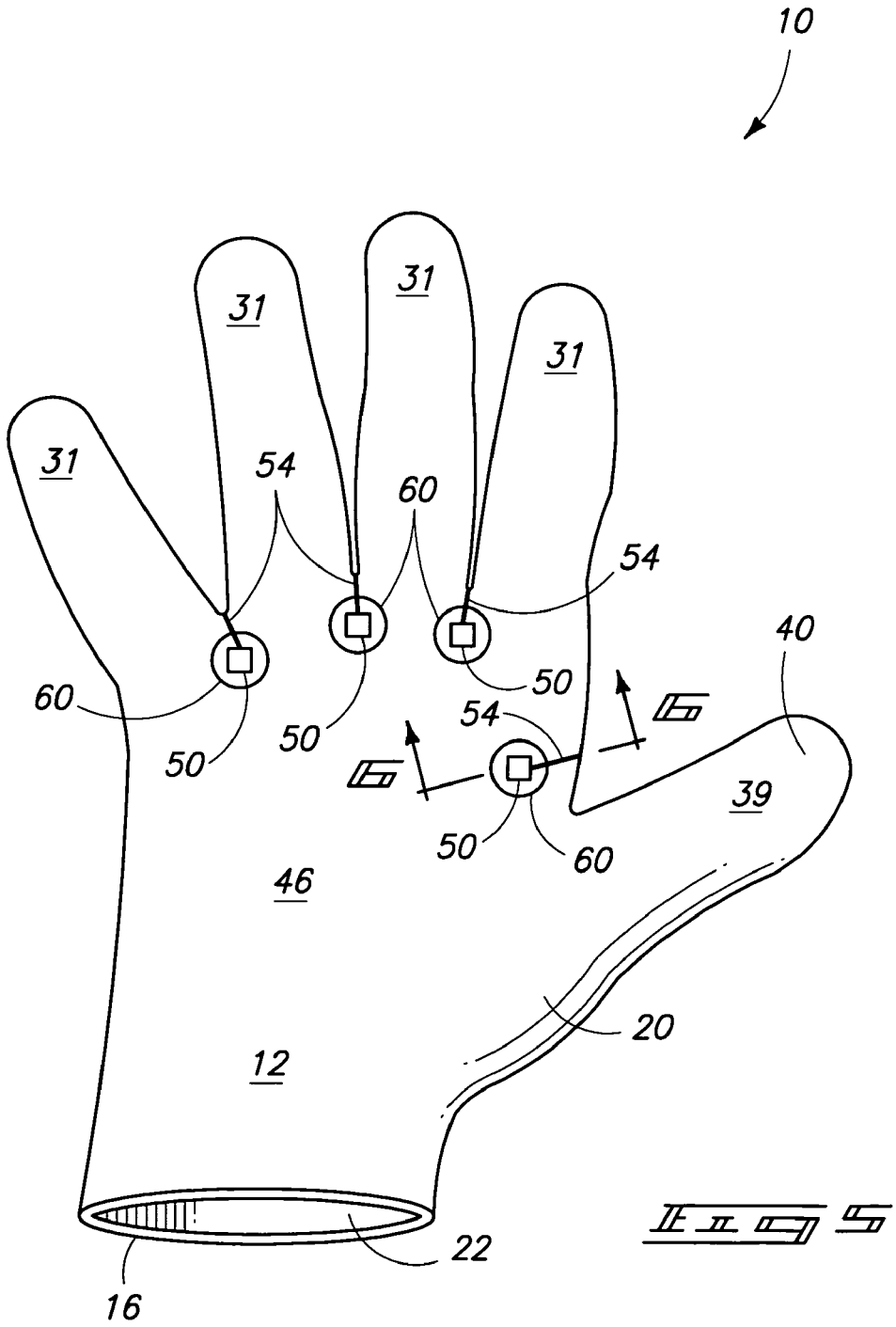
FIG. 5 is an enlarged view of FIG. 1, showing the light emitting diodes positioned in the crotches on the front surface with the light emitting diodes encapsulated with a corrosion resistant material.

As shown in FIG. 5, one or more light emitting diode, LED, 50 is positioned upon the front surface 12 of the glove in either the finger crotch area 36 or thumb crotch area 44. The emitted light may be of any color available on the market. However, it has been found that the best color is perhaps red as it provides suitable rumination and yet does not cause the pupil of the human eye to constantly adjust between light and darkness. The LED 50 may be joined with wiring 54 extending from the LED through the associated crotch 36, 44 to the back surface 14 such that the wiring does not cross over any base knuckle areas 34, 42. From there the wiring 54 may join to a switch 56 suitable for controlling power to the LED 50 and to a power source 58. The switch and power source may be positioned between the outer layer 20 and lining 18 adjacent the back surface 14. The wiring 54 desirably is positioned between the outer layer 20 and the lining 18 as shown in FIG. 2.

Figure 6:
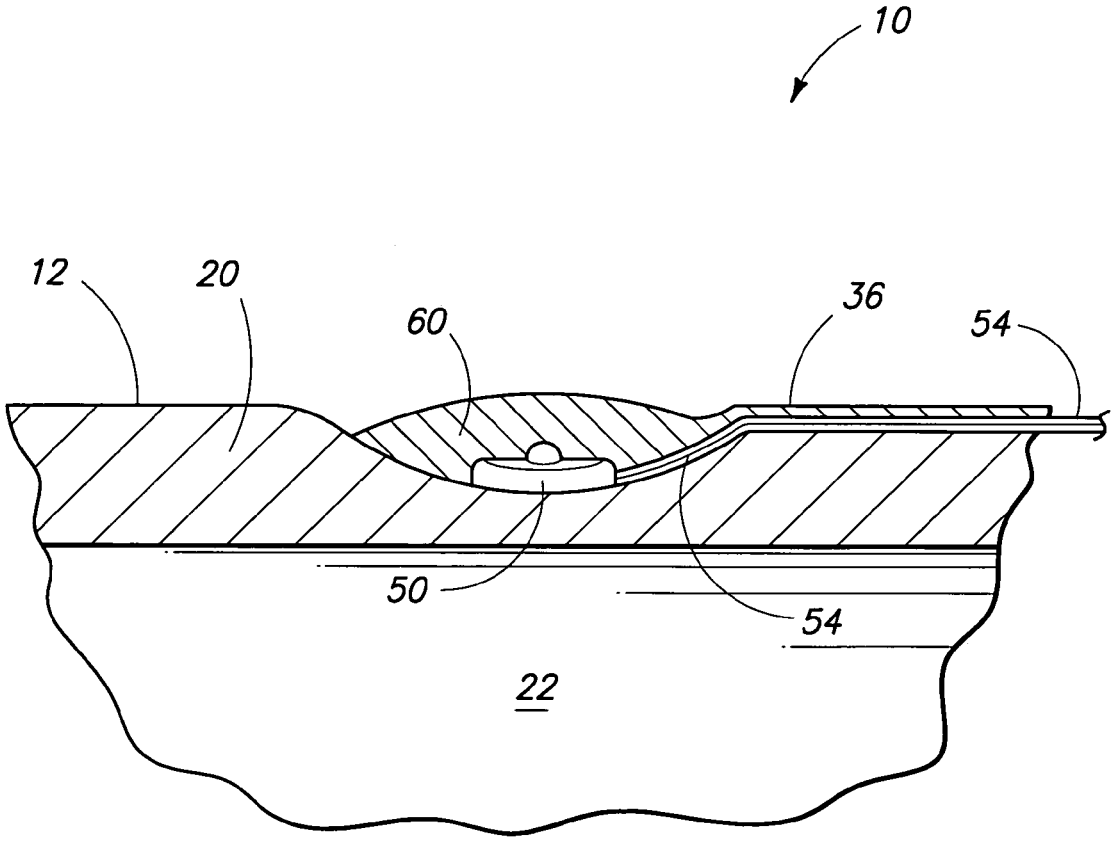
FIG. 6 is an enlarged cross-sectional view of one of the light emitting diodes as shown in FIG. 5.

As shown in FIG. 6, the wiring 54 and the LED 50 are preferably coated with a clear or translucent, flexible polymer, such as epoxy, to provide a substantially smooth surface on the front surface 12 of the outer layer 20. Such coating 60 should encapsulate the connection between the wiring 54 and LED 50 to preclude damage to the LED and corrosion from sweat that may be found in the glove 10. As seen in FIG. 6, the flexible polymer coating 60 does not extend substantially outwardly relative to the outer layer 20 of the glove and is substantially coplanar therewith, thus precluding the risk of damage to the LED 50 and the wiring 54. Flexibility and physical size may be varied by the manufacturer to provide the desired protection and yet offer minimal interference to the user.

The present invention has been described with reference to the preferred embodiment. Those skilled in the art will see that variations may be made without departing from the spirit and scope of the present invention. This inventor asserts entitlement to all rights provided to him under the patent laws of the United States of America.

I claim:

1. A lighted glove, comprising:

an outer layer having a front surface and a back surface, the front surface corresponding to a palm area of a hand;

fingers formed by the outer layer, each finger having a base knuckle area;

a finger crotch area defined by the area between two adjacent finger base knuckle areas; and a light emitting diode positioned upon the front surface of the outer layer in the finger crotch area, and which is substantially coplanar with the outer layer.

2. The lighted glove as claimed in claim 1, and wherein the light emitting diode is coated with a substantially translucent polymer.

3. The lighted glove as claimed in claim 2, and wherein the light emitting diode is coated by the polymer such that the front surface of the outer layer is substantially smooth.

4. The lighted glove as claimed in claim 1, and further comprising a plurality of light emitting diodes.

5. The lighted glove as claimed in claim 1, and further comprising wiring electrically joining the light emitting diode to a power source.

6. The lighted glove as claimed in claim 5, and further comprising a lining which underlies the outer layer.

7. The lighted glove as claimed in claim 6, and wherein the wiring is positioned between the lining and the outer layer.

8. The lighted glove as claimed in claim 6, and wherein the power source is a battery positioned between the lining and the outer layer.

9. A lighted glove, comprising:

an outer layer having a front surface and a back surface, the front surface corresponding to a palm area of a hand;

a finger formed by the outer layer and having a finger base knuckle area;

a thumb formed by the outer layer and having a thumb base knuckle area;

a thumb crotch area defined by the area between the finger base knuckle area and the thumb base knuckle area; and a light emitting diode positioned upon the front surface of the outer layer in the thumb crotch area, and which does not substantially extend outwardly relative to the outer layer.

10. The lighted glove as claimed in claim 9, and wherein the light emitting diode is coated with a substantially translucent polymer.

11. The lighted glove as claimed in claim 10, and wherein the light emitting diode is coated by the polymer such that the front surface of the outer layer is substantially smooth.

12. The lighted glove as claimed in claim 9, and further comprising:

a lining which underlies the outer layer; and wiring electrically joining the light emitting diode to a battery, and wherein the wiring and the battery are positioned between the lining and the outer layer.

13. A lighted glove, comprising:

an outer layer defining the shape of a human hand with a palm area, and which has a front surface and a back surface, the front surface corresponding to the palm area of the hand;

four fingers formed by the outer layer, each finger having a base knuckle area a thumb formed by the outer layer, and which is adjacent to the four fingers, and further having a thumb base knuckle area;

three finger crotch areas defined by each area between two adjacent finger base knuckle areas;

a thumb crotch area defined by the area between one of the four finger base knuckle areas and the thumb base knuckle area; and a plurality of light emitting diodes positioned upon the front surface of the outer layer such that at least one light emitting diode is positioned in each of the finger crotch areas and the thumb crotch area, and wherein the plurality of light emitting diodes does not extend substantially outwardly relative to the outer layer so as to impede the usefulness of the glove.

14. The lighted glove as claimed in claim 13, and wherein the light emitting diode is coated with a substantially translucent polymer.

15. The lighted glove as claimed in claim 14, and wherein the light emitting diode is coated by the polymer such that the front surface of the outer layer is substantially smooth.

16. The lighted glove as claimed in claim 15, and further comprising:

a lining which underlies the outer layer; and wiring electrically joining the plurality of light emitting diodes to at least one battery, and wherein the wiring and the at least one battery are positioned between the lining and the outer layer.

17. A lighted glove, comprising:

an outer layer which has a front surface and a back surface, the front surface corresponding to a palm area of a hand;

a plurality of fingers formed by the outer layer, each finger having a base knuckle area;

a thumb formed by the outer layer, and which is adjacent to the plurality of fingers, and which further has a thumb base knuckle area;

at least one finger crotch area defined by the area between two adjacent finger base knuckle areas;

a thumb crotch area defined by the area between one of the plurality of finger base knuckle areas and the thumb base knuckle area; and a plurality of light emitting diodes positioned upon the front surface of the outer layer such that at least one light emitting diode is positioned in each of the finger crotch areas and the thumb crotch are, and wherein the plurality of light emitting diodes are coated with a substantially translucent polymer such that the front surface of the outer layer is substantially smooth and coplanar with the outer layer.

18. The lighted glove as claimed in claim 17, and further comprising wiring electrically joining the plurality of light emitting diodes to a power source.

19. The lighted glove as claimed in claim 18, and further comprising a lining which underlies the outer layer, and wherein the wiring is positioned between the lining and the outer layer.

20. The lighted glove as claimed in claim 19, and wherein the power source is a battery positioned between the lining and the outer layer.

* * * * *